United States Patent [19]

Jacobsen

[11] Patent Number: 4,993,164

[45] Date of Patent: Feb. 19, 1991

[54] MEASURING DEVICE

[76] Inventor: Joseph M. Jacobsen, 2 Fr. Griffin Avenue, Galway, Ireland

[21] Appl. No.: 548,206

[22] Filed: Jul. 5, 1990

Related U.S. Application Data

[63] Continuation of Ser. No. 191,649, May 9, 1988, abandoned.

[30] Foreign Application Priority Data

May 13, 1987 [IE] Ireland ..... 1239/87

[51] Int. Cl.[5] ..... G01B 5/20; A47C 3/00

[52] U.S. Cl. ..... 33/561.3; 297/284; 33/512

[58] Field of Search ..... 33/512, 515, 561.1, 33/561.2, 561.3; 128/781; 297/284

[56] References Cited

U.S. PATENT DOCUMENTS

| | | | |
|---|---|---|---|
| 889,224 | 6/1908 | Haas | 33/175 |
| 1,328,538 | 1/1920 | Newberg et al. | 33/176 |
| 2,220,422 | 11/1940 | Nelson | 33/176 |
| 2,324,672 | 7/1943 | Bierman et al. | 33/176 |
| 2,519,508 | 8/1950 | Schnorbus | 33/176 |
| 2,756,809 | 7/1956 | Endersen | 297/284 |
| 3,081,129 | 3/1963 | Ridder | 297/284 |
| 3,112,137 | 11/1963 | Drenth | 297/284 |
| 4,153,293 | 5/1979 | Sheldon | 297/284 |
| 4,437,702 | 3/1984 | Agosta | 297/284 |
| 4,688,853 | 8/1987 | Watts | 297/284 |

FOREIGN PATENT DOCUMENTS

| | | | |
|---|---|---|---|
| 141652 | 5/1985 | European Pat. Off. | 297/284 |
| 3106882 | 9/1982 | Fed. Rep. of Germany . | |
| 0012439 | 1/1980 | Japan | 33/515 |
| 483106 | 9/1975 | U.S.S.R. | 297/284 |
| 0150117 | 9/1920 | United Kingdom | 33/175 |
| 2051568 | 1/1981 | United Kingdom | 128/781 |

*Primary Examiner*—Thomas B. Will
*Attorney, Agent, or Firm*—Thomas A. Gallagher

[57] ABSTRACT

A measuring apparatus for determining the contour of the back of an individual has a base, a seat portion and a back portion. The back portion is provided with a back engaging member having a deformable sheet member which carries a number of spring steel transverse strips. Transverse members mounted on support members mount the back engaging member to the back portion. The support members are movable vertically to deform the back engaging member to take up the vertical contour of the individual.

14 Claims, 9 Drawing Sheets

MEASURING DEVICE

This is a continuation of application, Ser. No. 191,649 filed May 9, 1988 now abandoned.

FIELD OF THE INVENTION

The present invention relates to apparatus for measuring the contour of the back of an individual in a seated position, and in particular to apparatus of the type more commonly referred to as a measuring chair which comprises a seat portion, an upstanding back portion and a back engaging member provided in the back portion for measuring the vertical contour of an individual's back.

BACKGROUND TO THE INVENTION

In many cases, people prefer to have a chair with a back portion which adequately supports their back. This is particularly so in the case of people who have back injuries or suffer from congential back problems. In order that the back be adequately supported, it is important that the back portion of the chair should follow the contours of the individual's back. In particular, it is desirable that the back portion should follow the vertical contour of the individual's back and preferably also the horizontal contours. This necessitates the manufacture of a special chair for each individual. These chairs are normally referred to as orthopaedic chairs. To manufacture such chairs, it is necessary to determine the contour of the individual's back, and this is most easily carried out using what is generally known as a measuring chair.

PRIOR ART

Two such measuring chairs are described in U.S. Pat. No. 3,081,129 and German Offenlegungsschrift No. 3106882. The measuring chair of the former specification comprises a seat portion and a back portion which is pivotal to any desired angle relative to the seat portion. The back portion and seat portion both comprise a plurality of pins extending thereform, each pin having a head thereon. The pins are slidable into and out of the back and seat portions and may be locked in any desired position. The individual to be measured sits on the chair with his back resting against the back portion. Some of the pins retract into the seat and back portion to follow the contour of the individual's back. When the individual rises from the chair, the pins remain in the positions which they took up. One can then measure the relative position of each pin to a datum plane and from that reconstruct the contour of the individual's back in any suitable material to form a backrest and seat of a chair.

In German Offenlegungsschrift No. 3106882 a plurality of transverse slats are mounted on the seat portion and back portion of the chair. The slats are mounted at their free ends on members which are slidably mounted in the back and seat portion. As an individual sits on the chair the slidable members are moved relative to the back and seat portions until the transverse slats take up the back and seat profile of the individual. The slidable members are then locked in position relative to the seat and back portions. When the individual rises from the chair the relative positions of the slats to the back and seat portions can then be measured and the profile reconstructed.

While both of these chairs enable the profile of an individual to be measured, they are particularly difficult and complex to operate. In both cases, a very considerable number of measurements have to be taken in order to reconstruct a reasonable profile. In the case of the chair of U.S. Pat. No. 3,081,129 a reading must be taken of all the pins in the back and seat portion. Even where one wishes only to reconstruct the profile of the individual's back, a considerable amount of measurements are still required. In the case of the measuring chair of the German Offenlegungsschrift, while not as many measurements are required, still a considerable number must be taken.

OBJECTS OF THE INVENTION

One object of the invention is to provide apparatus for measuring the contour of the back of an individual which overcomes the problems of known prior art apparatus. Another object of the invention is to provide such measuring apparatus, whereby relatively few measurements are required in order to define the curves which constitute the vertical contour of an individual's back. Another object of the invention is to provide a measuring apparatus in which relatively few measurements are required in order to define the horizontal curvatures which constitute the contours of an individual's back. Another object of the invention is to provide measuring apparatus which can be readily easily used and which is not complex. A further object of the invention is to provide a relatively inexpensive measuring apparatus. A further object of the invention is to provide a measuring apparatus which comprises a back engaging portion which may be used in the formation of the back portion of an orthopaedic chair. Another object of the invention is to provide an orthopeadic chair and/or a chair in which the back portion is adjustable to suit the needs of an individual's back.

SUMMARY OF THE INVENTION

According to the invention there is provided apparatus for measuring the contour of the back of an individual in a seated position, the apparatus comprising a chair which comprises a seat portion, an upstanding back portion extending upwardly from the seat portion, a back engaging member formed from an elongated flexible member extending in a generally upward direction and being deformable to take up the vertical contour of at least part of the individual's back, and at least two mounting means for mounting the back engaging member to the upstanding back portion at respective vertically spaced apart positions.

In one embodiment of the invention, at least one of the mounting means is movable relative to the upstanding back portion, and at least one of the mounting means slidably engages the back engaging member, clamping means being provided to secure the back engaging member to the mounting means.

In another embodiment of the invention, an elongated slot is provided in the back engaging member to slidably engage the clamping means.

Preferably, three mounting means are provided, namely an upper mounting means, an intermediate mounting means and a lower mounting means, the three mounting means being movable relative to the upstanding back portion and the lower and intermediate mounting means slidably engaging the back engaging member.

In another embodiment of the invention, the back portion comprises a pair of spaced apart upstanding members, and each mounting means comprises a support member extending between and slidably mounted on the upstanding members, and a transverse member for carrying the back engaging member, the transverse member extending parallel with and mounted on the main support member, the transverse member being pivotal relative to the main support member.

In a further embodiment of the invention, the back engaging member extends part of the width of the back portion and is centrally located relative to the back portion and a plurality of transverse strips of resilient material are secured to the back engaging member and extend sidewardly thereof from each side of the back engaging member to take up horizontal contours of the individual's back.

In another embodiment of the invention, a pair of elongated side members extending in a generally upwardly direction are provided on the back portion to engage the free ends of the transverse strips, the side members being movable relative to the back portion to engage and deform the transverse strips to take up the horizontal contours of the individual's back.

Advantageously, a neck engaging member is provided on the back portion to engage the neck of the individual, the neck engaging member being movable inwardly and outwardly and vertically relative to the back portion.

Preferably, the back portion is pivotal relative to the seat portion.

Advantageously, measuring means are provided to measure the vertical distance between the respective mounting means and a datum point.

Additionally, the invention provides a method for measuring the contour of the back of an individual using the apparatus according to the invention, the method comprising the steps of seating the individual in the chair, adjusting the height of the respective mounting means with the back engaging member substantially straight so that the top mounting means is adjacent the shoulders of the individual, the intermediate mounting means is adjacent the mid point of the individual's back, and the lower mounting means is below the level of the seat, raising the lower mounting means towards the intermediate mounting means to cause the portion of the back engaging member between the lower and intermediate mounting means to curve outwardly to engage the individual's back, lowering the top mounting means towards the intermediate mounting means to cause the portion of the back engaging member intermediate the top and intermediate mounting means to curve inwardly to engage the individual's back, recording the relative positions of the respective mounting means to a datum point, and lowering the lower mounting means and intermediate mounting means until the back engaging member is substantially straight, and recording the new relative positions of the lower and intermediate mounting means relative to the datum point.

Further, the invention provides a chair comprising a seat portion, an upstanding back portion extending upwardly from the seat portion, a back engaging member formed from an elongated flexible member extending in a generally upward direction and being deformable to take up the vertical contour of at least part of the individual's back, and at least two mounting means for mounting the back engaging member to the upstanding back portion at respective vertically spaced apart positions.

ADVANTAGES OF THE INVENTION

The advantages of the apparatus according to the invention are many. One of the more important advantages is the fact that by taking relatively few measurements one can accurately record the contour of an individual's back which may readily easily be reproduced in a mould or the like for moulding an orthopaedic chair. A particular advantage of the invention is achieved by virtue of the fact that the back engaging member is provided by a sheet member. This considerably reduces the number of measurements that have to be recorded in order to accurately define the contour of the individual's back.

A further advantage of the invention is that it provides apparatus which is relatively easily operated and also gives relatively precise measurements. A further advantage of the invention is that the apparatus according to the invention is relatively easily manufactured and constructed.

Where three mounting means are provided for mounting the back engaging member to the back portion, a further advantage is achieved in that the measuring chair enables the two curvatures of the back of an individual to be recorded, namely the lower concave curvature of an individual's back and the upper convex curvature.

Where the back engaging member comprises a plurality of transverse strips, a further advantage is achieved in that it is possible to record the horizontal contours of the individual's back.

Where the back portion is inclined relative to the seat portion, this provides the further advantage in that it enables the angle of the back portion to the seat portion which is most desirable to the individual to be recorded.

These and other advantages and objects of the invention will be more clearly understood from the following description of a preferred embodiment thereof, which is given by way of a non-limiting example.

DETAILED DESCRIPTION OF THE INVENTION

Figure 1:
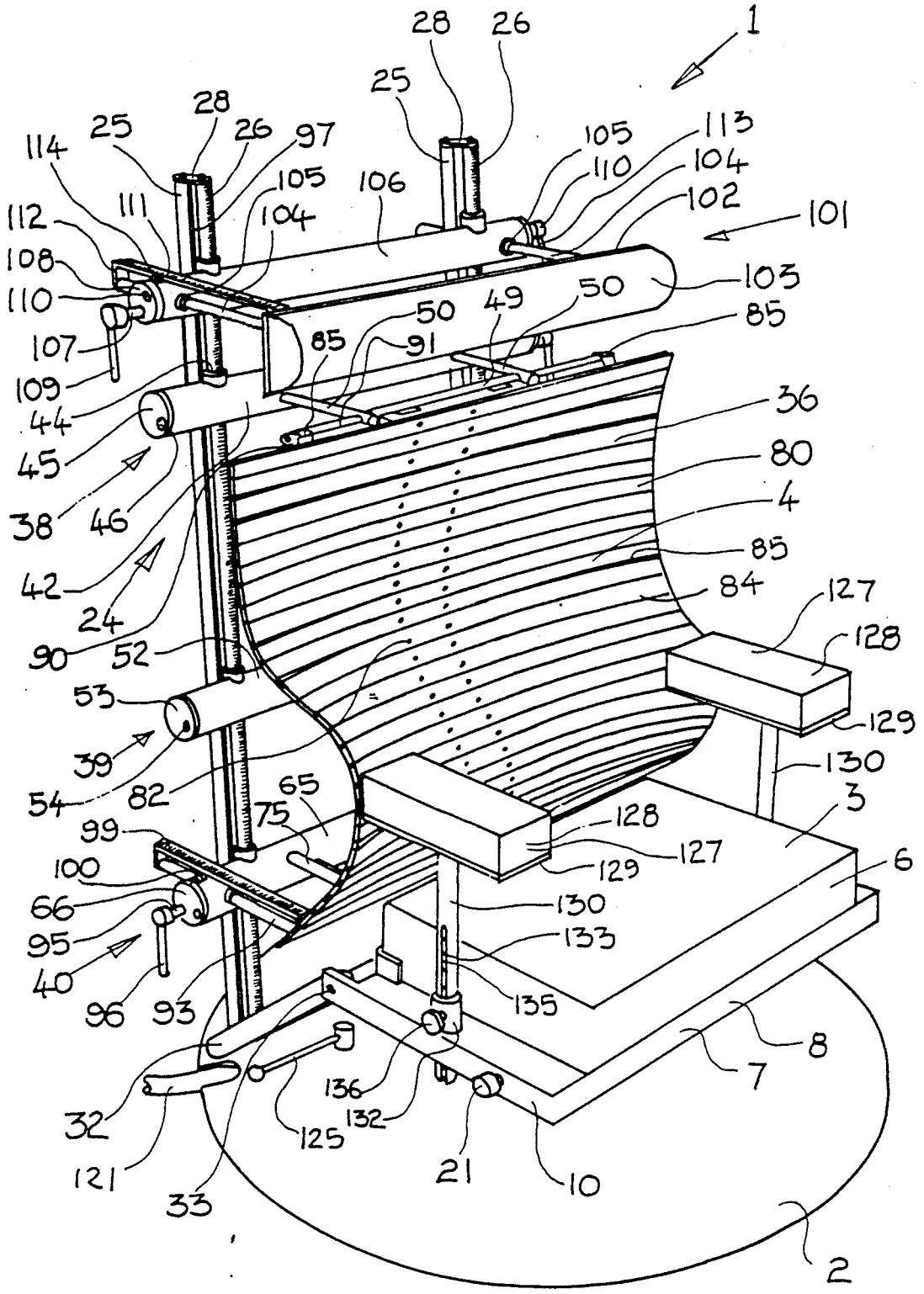
FIG. 1 is a perspective view of apparatus according to the invention.
Figure 2:
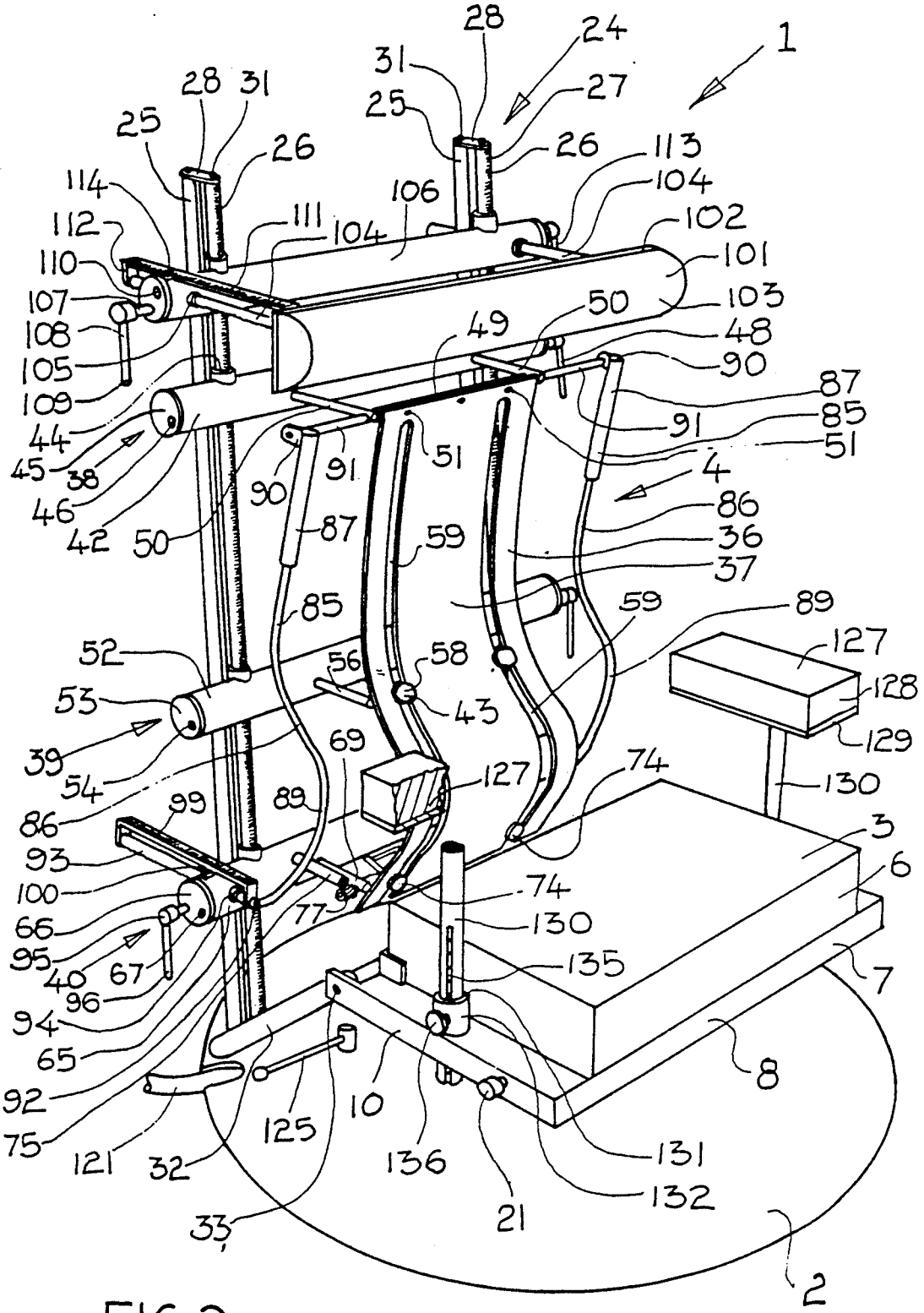
FIG. 2 is a perspective view of the apparatus of FIG. 1 with portion of the apparatus removed.
Figure 3:
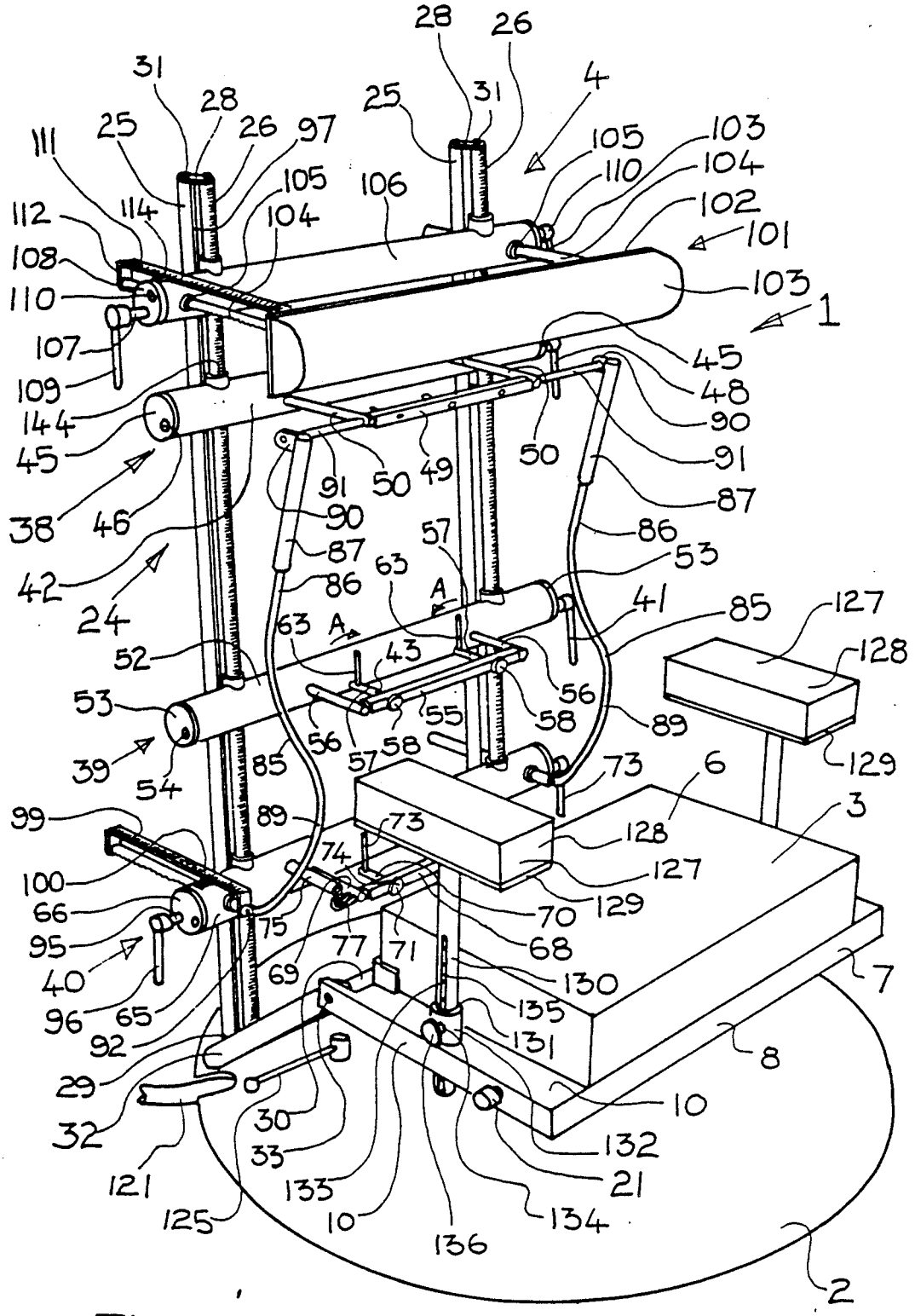
FIG. 3 is a perspective view of the apparatus of FIG. 1 with another portion of the apparatus removed.

Referring to the drawings, and initially to FIGS. 1 to 24, there is illustrated apparatus according to the invention for measuring the contour of the back of an individual, in this case the apparatus is in the form of a measuring chair indicated generally by the reference numeral 1. The measuring chair 1 comprises a ground engaging base 2, a seat portion 3 and a back portion 4. The seat portion 3 is mounted on the base 2 by a hydraulic ram 5, as will be described below. The back portion 4 is pivotally connected to the seat portion 3 so that the angle of the back portion 4 may be varied relative to the seat portion 3. This is also described below.

Figure 11:
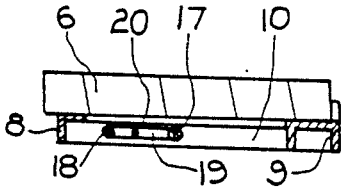
FIG. 11 is a side sectional view of another portion of the apparatus of FIG. 1.
Figure 12:
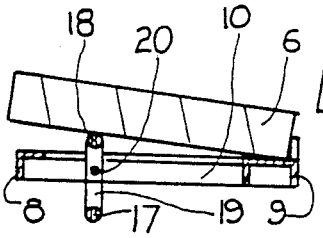
FIG. 12 is a side sectional view of the portion of FIG. 11 in a different position.
Figure 13:
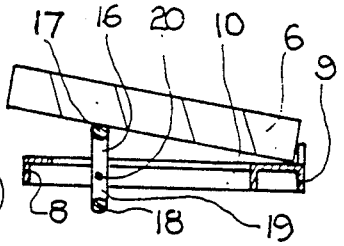
FIG. 13 is a side sectional view of the portion of FIG. 11 in a still further different position.
Figure 10:
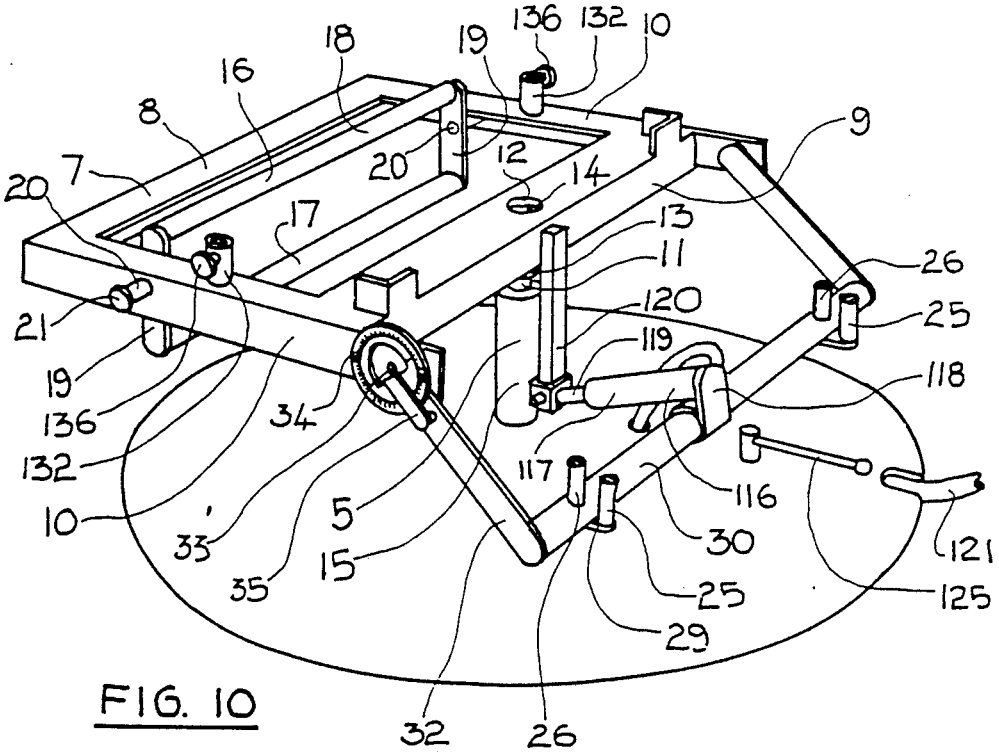
FIG. 10 is a perspective view of portion of the apparatus of FIG. 1.

The seat portion 3 comprises an upholstered seat 6 which rests on a steel framework 7. The framework 7 comprises front and rear members 8 and 9 joined by side members 10. A piston rod 11 of the hydraulic ram 5 engages a tapered hole 12 in the rear member 9 and a boss 13, and is secured therein by a screw 14. The ram housing 15 is welded to the base 2. Means for varying the inclination of the seat 6 relative to the framework 7 is provided by an adjusting member 16 comprising a pair of rods 17 and 18 joined by end members 19. Pivot members 20 extending from the end members 19 pivotally engage the side members 10 of the framework 7. The pivot members 20 are provided on the end members 19 nearer the rod 18 than the rod 17. A knob 21 on one of the pivot members 20 permits rotation of the member 16. When the member 16 lies flat in the framework 7 as illustrated in FIG. 11 the seat 6 is supported only on the framework 7 and rests parallel therewith. On rotation of the adjusting member 16 so that the end members 19 are essentially vertical with the member 18 at the top position, the seat 6 rests on the member 18, thereby inclining the seat relative to the framework 7, see FIG. 12. In this case, the angle of inclination is approximately 5°. When the adjusting member 16 is rotated so that the rod 17 engages the seat 6 as illustrated in FIG. 13, the seat is inclined at an angle of approximately 10° relative to the framework 7. A stop clip (not shown) to retain the adjusting member 16 in any of the three desired positions illustrated in FIGS. 11 to 13 is provided on the side member 10 to engage the knob 21.

The back portion 4 comprises a back framework 24 of steel which comprises pair of spaced apart upstanding members 25, each of which support respective gear racks 26 of partly circular cross section extending the length of the members 25 and connected to the members 25 by brackets 28 and 29. Screws 31 secure the brackets 28 and 29 to the member 25 and gear racks 26. The upstanding members 25 are joined by a bottom cross member 30. The bottom cross member 30 is welded to the brackets 29. A pair of side members 32 welded to the bottom cross member 30 are pivotally connected by pivot pins 33 to the side members 10 of the seat framework 7, thereby permitting pivotal movement of the back framework 24 relative to the seat framework 7. A protractor 34 is mounted on one of the side members 10 of the seat framework 7 and a pointer 35 on one of the side members 32 enables the angular position of the back portion 4 relative to the seat portion 3 to be recorded, see FIG. 10.

A flexible back engaging member 36 comprising an elongated flexible sheet member 37 of carbon fibre is mounted to the back framework 24 and is deformable to take up the contour of the back of an individual. The sheet member 37 can be most clearly seen in FIG. 2 and this sheet member 37 takes up the vertical contour of the individual's back. The carbon fibre material of the sheet member 37 is of such strength that it can be easily deformed to take up the curvature in a vertical direction of an individual's back, while at the same time it is sufficiently rigid not to deform easily once the curvature is set in the sheet member by clamping as will be described below. A plurality of transverse strips 80 of spring streel material are secured to the sheet member 37 by aluminium mounting members 81. The transverse strips 80 take up the horizontal contour of the individual's back as is described below. A membrane 84 of clear silicon rubber is formed over and around the transverse strips 80, thereby presenting a substantially smooth surface to the back of the individual.

The back engaging member 36 is mounted on the framework 24 by three mounting means, namely, a first or a top mounting means 38, and to a second mounting means, namely, an intermediate mounting means 39 and a lower mounting means 40. The top mounting means 38 comprises a support member 42 of tubular steel slidable on the gear racks 26. Bronze bushes 44 in the support members 42 slidably engage the gear racks 26. End caps 45 in the support member 42 rotatably support a shaft 46 which carries pinions 47 which engage the teeth 27 of the gear racks 26, see FIGS. 19 and 20. A handle 48 on the shaft 46 provides for rotation thereof. Thus, on rotation of the shaft 46 the support member 42 is raised or lowered on the gear rack 26. A top transverse member 49 for carrying the back engaging member 36 is pivotally mounted on a pair of side members 50 extending from the support member 42. The back engaging member 36 is secured to the transverse member 49 by screws 51 through the sheet member 37.

The intermediate mounting means 39 comprises a support member 52 similar to the support member 42. The support member 52 is of tubular steel with end caps 53 which rotatably support a shaft 54 carrying pinions (not shown) similar to the pinions 47 which engage the gear rack 26 for raising and lowering the support member 52. A handle 41 rotates the shaft 54. An intermediate transverse member 55 for carrying the back engaging member 36 is pivotally mounted to a pair of side members 56 extending from the main support member 52. A resilient strip 139 of plastics material on the intermediate transverse member 55 engages the sheet member 37. Clamping means 43 comprising spindles 57 terminating in heads 58 slidably engage corresponding slots 59 in the sheet member 37. The spindles 57 are rotatable and slidable in holes 64 through the transverse member 55 and bosses 62. Pins 60 extending from the spindles 57 engage camming slots 61 in the bosses 62 which are welded to the transverse member 55. Handles 63 on the spindles 57 are provided for rotating the spindles in the bosses 62. Accordingly, as the handles 63 are rotated in the direction of the arrow A, the heads 58 of the spindles 57 are drawn against the transverse member 55 to clamp the sheet member 37 therebetween.

The bottom mounting member 40 comprises a support member 65 of tubular steel similar to the main support member 42. End caps 66 are provided at the ends of the support member 65 to rotatably support a shaft 67 which carries pinions 79 engagable with the gear rack 26 for raising and lowering the support member 65. A handle 73 rotates the shaft 67. A lower transverse member 68 is pivotally mounted on a pair of side members 69 extending from the main support member 65. Clamping means 74 comprising spindles 70 with heads 71 similar to the clamping means 43 clamp the sheet member 37 to the transverse member 68. A tubular member 75 extending from the support member 65 slidably supports a worm 76 which engages a worm wheel 77 on the transverse member 68. The worm 76 terminates in a knob 78, see FIG. 23. Accordingly, on rotating the worm 76 in the tubular member 75, the worm wheel 77 is rotated, thereby pivoting the transverse member 68 in the side members 69. This permits the angle of the back engaging member 36 at the transverse member 68 to be varied to further facilitate the back member following the contour of the individual's back.

Returning now to the back engaging member 36, the transverse strips 80 of spring steel are secured to the carbon fibre sheet member 37 by the mounting members 81 of aluminium. The mounting members 81 are bonded to the sheet member 37 by a suitable adhesive and the transverse strips 80 are secured by rivets 82 to the mounting members 81. Two recesses 83 are formed in each mounting member 81 to accommodate the heads 58 and 71 of the clamping means 43 and 74 on each transverse member 55 and 68. As can be seen, the transverse strips 80 are secured by the rivets 82 to the mounting members 81 well in from their ends to permit the transverse strips 80 to flex outwardly as will now be described.

A pair of side members 85 extend between the top support member 42 and the bottom support member 65 and engages the transverse strips 80. Each side member 85 comprises two portions of tubular steel which telescope into each other, namely an inner member 86 and an outer member 87. This facilitates lengthening and shortening of the side members as the support members 42 and 65 are moved relative to each other. The lower portion of the inner member 86 is of arcuate shape at 89. Brackets 90 on the top of the side members 85 pivotally engage shafts 91 extending from the top transverse member 49. The lower ends of each side member 85 are pivotally connected at 92 to a pair of gear racks 93 of partly circular cross section, see FIGS. 21 and 22. The grear racks 93 are slidable in bushes 94 in the lower support member 65. A shaft 95 similar to the shaft 79 rotatably engages the end caps 66 and carries a pair of pinions 72 which engage the gear racks 93 for moving the racks 93 inwardly and outwardly relative to the support member 65. A handle 96 rotates the shaft 95. Accordingly, when the back engaging member 36 has been deformed to follow the vertical contour of the individuals back, the side members 85 are moved outwardly to bend the transverse strips 80 around to follow the horizontal contours of the individual's back, see FIG. 5.

A rule 97 graduated in centimeters and inches is secured to one of the upstanding members 25. Pointer marks 98 are provided on each support member 42, 52 and 65 for recording the relative positions of the members 42, 52 and 65 from a datum, see FIG. 24. A rule 99 also graduated in centimeters and inches is mounted on one of the gear racks 93 and a pointer mark 100 is provided on the lower support member 65 for recording the relative position of the side member 85 to the support member 65.

A neck engaging member 101 comprises a cross member 102 which supports an upholstered pad 103 for engaging the back of the neck of the individual. A pair of gear racks 104 of partly circular cross section extending rearwardly from the member 102 slidably engage bushes 105 in a support member 106 similar to the lower support member 65. A shaft 107 rotatable in end caps 108 carries a pair of pinions (not shown) which engage the gear racks 104 for moving the neck engaging member 101 inwardly and outwardly. A handle 109 rotates the shaft 107. A shaft 110 similar to the shaft 67 of the lower support member 65 carries pinions (not shown) for engaging the gear racks 26 for raising and lowering the neck engaging member 101. A handle 113 rotates the shaft 110. A rule 111 graduated in centimeters and inches is mounted on one of the gear racks 104 by a bracket 112 and the cross member 102. A pointer mark 114 is provided on the support member 106 to record the position of the neck engaging member 101 relative to the support member 106.

The back portion 4 is pivotal relative to the seat portion 3 by a hydraulic ram 116. The ram housing 117 is secured by a bracket 118 to the bottom cross member 30. The piston rod 119 is pivotally connected to a bracket 120 extending down from the seat framework 7.

A two way valve 122 mounted beneath the base 2 diverts a hydraulic fluid supply from the ram 5 to the ram 116 and vice versa. Hydraulic hoses 123 and 124 connect the valve 122 respectively to the ram 5 and ram 116. A handle 125 switches over the valve 122 from one position to the other. Hydraulic fluid is delivered to the valve 122 by a suitable hydraulic fluid pressure source (not shown) through a hose 121.

Arm rests 127 having upholstered pads 128 supported on plates 129 are adjustably mounted to the seat framework 7 by tubular members 130. Each tubular member 130 engages a hole 131 through a side member 10 and boss 132 welded on the side members 10 of the framework 7. Holes 133 arranged at 2.5 cms intervals are provided in each tubular member 130 for engaging a pin 134 through the boss 132. A keyway 135 is provided in the tubular member 130 to engage the pin 134, thereby preventing rotation of the tubular member 130 as it is being raised and lowered. A knob 136 is provided on the pin 134 for operation thereof.

In use, the back engaging member 36 is mounted on the transverse members 49, 55 and 68 in its undeformed state and the clamping means 43 and 74 are left slack. The ram 5 is raised or lowered so that the seat 6 is at the right position for the individual. The angle of the upholstered seat 6 relative to the framework 7 is adjusted by the adjusting member 16 to suit the individual. The arm rests are adjusted up or down to the desired height. The angle of the back portion 4 is adjusted by operating the ram 116 through the valve 122. When the back portion 4 is at the desired angle relative to the seat portion 3, the height of the neck engaging member is adjusted by rotating the shaft 110 so that the neck engaging member is adjacent the back of the individuals neck. The upholstered pad 102 of the neck engaging member is moved outwardly by rotating the shaft 107 until the pad 102 engages the back of the individual's neck.

The height of the top support member 42 of the top mounting means 38 is adjusted so that the transverse member 49 is approximately at the position at the shoulders of the individual. This is achieved by rotating the shaft 46. The height of the intermediate support member 52 of the intermediate mounting means 39 is adjusted so that the transverse member 55 is about halfway down the individuals back. This is achieved by rotating the shaft 54.

Figure 4:
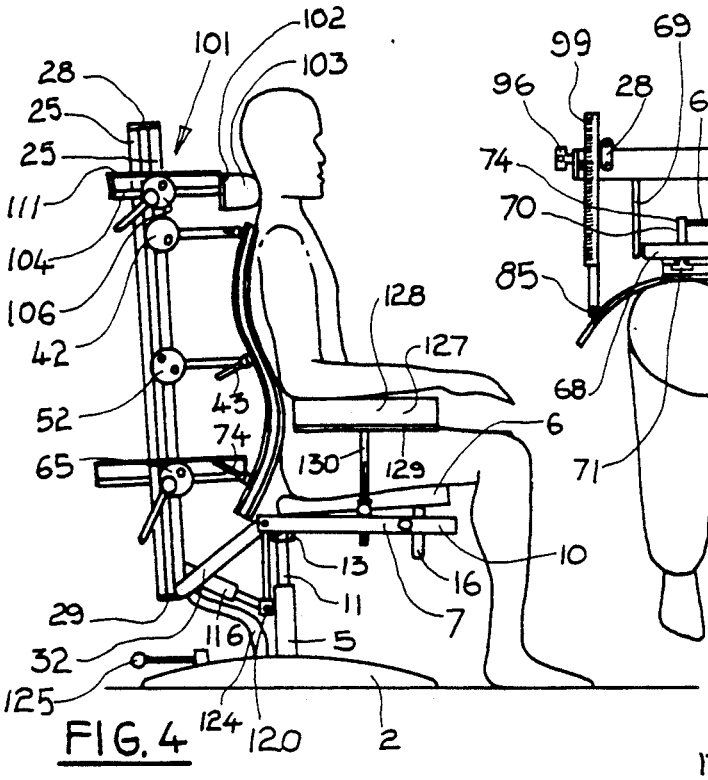
FIG. 4 is a side elevational view of the apparatus of FIG. 1 in use.
Figure 5:
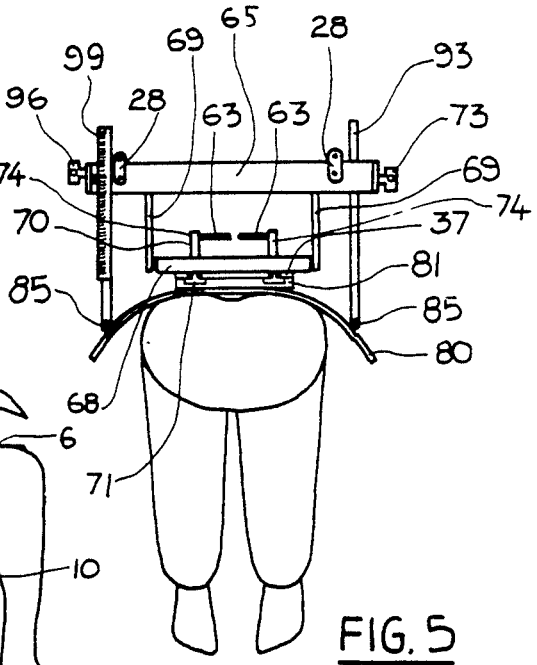
FIG. 5 is a sectional plan view of the apparatus of FIG. 1 in use.
Figure 16:
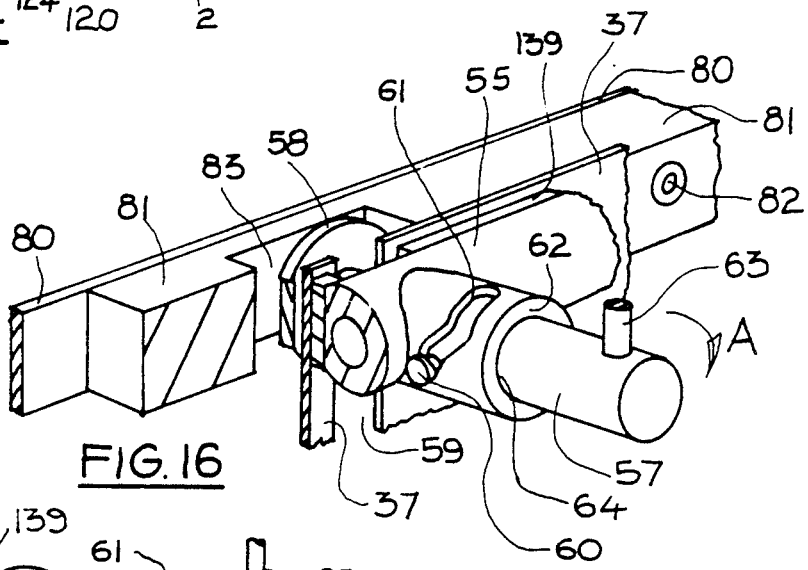
FIG. 16 is a partly cut-away perspective view of another detail of the apparatus of FIG. 1.
Figure 17:
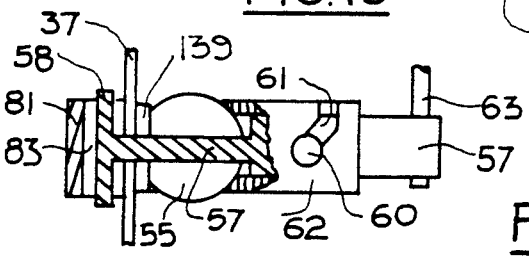
FIG. 17 is a side sectional view of the detail of FIG. 16.
Figure 18:
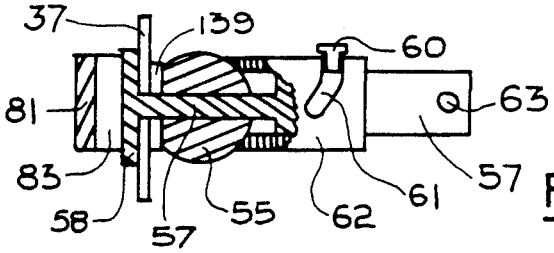
FIG. 18 is a side sectional view of the detail of FIG. 16 in a different position.
Figure 6:
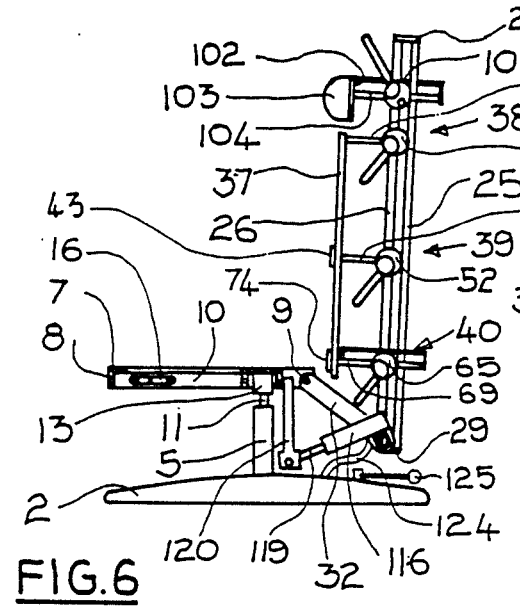
FIG. 6 is a side elevational view of the apparatus of FIG. 1 in position.
Figure 7:
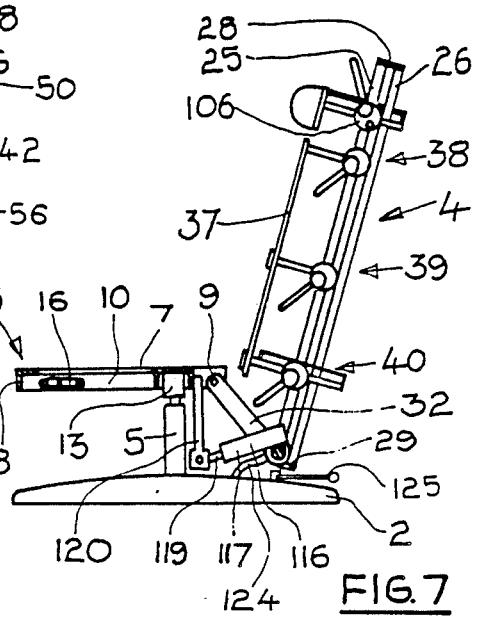
FIG. 7 is a side elevational view of the apparatus of FIG. 1 in another position.
Figure 8:
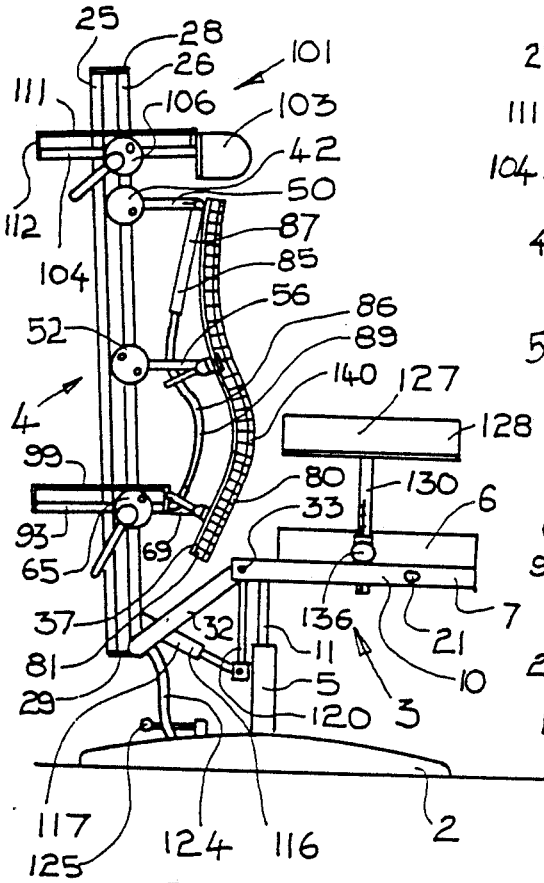
FIG. 8 is a side elevational view of the apparatus of FIG. 1 in a still further different position.
Figure 9:
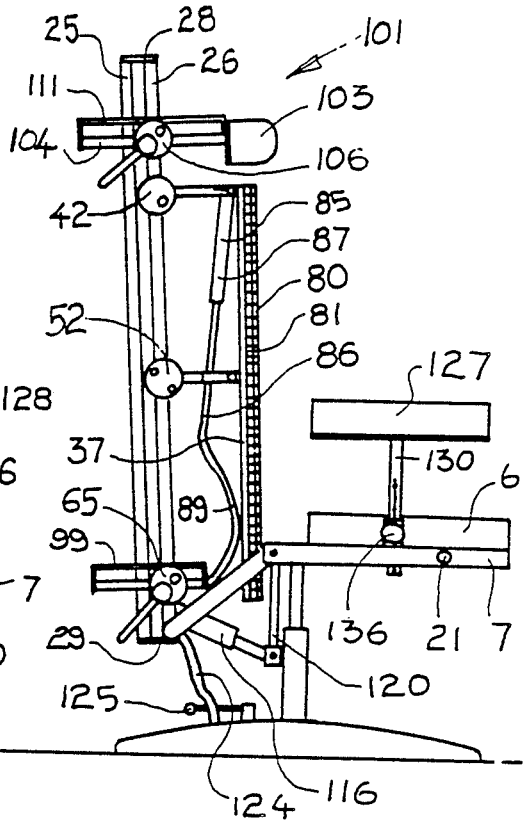
FIG. 9 is a side elevational view of the apparatus of FIG. 1 also in a different position.
Figure 14:
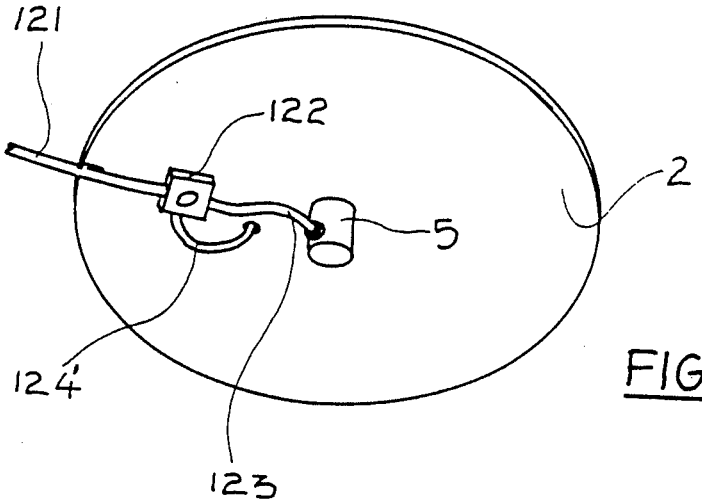
FIG. 14 is an underneath view of portion of the apparatus of FIG. 1.
Figure 15:
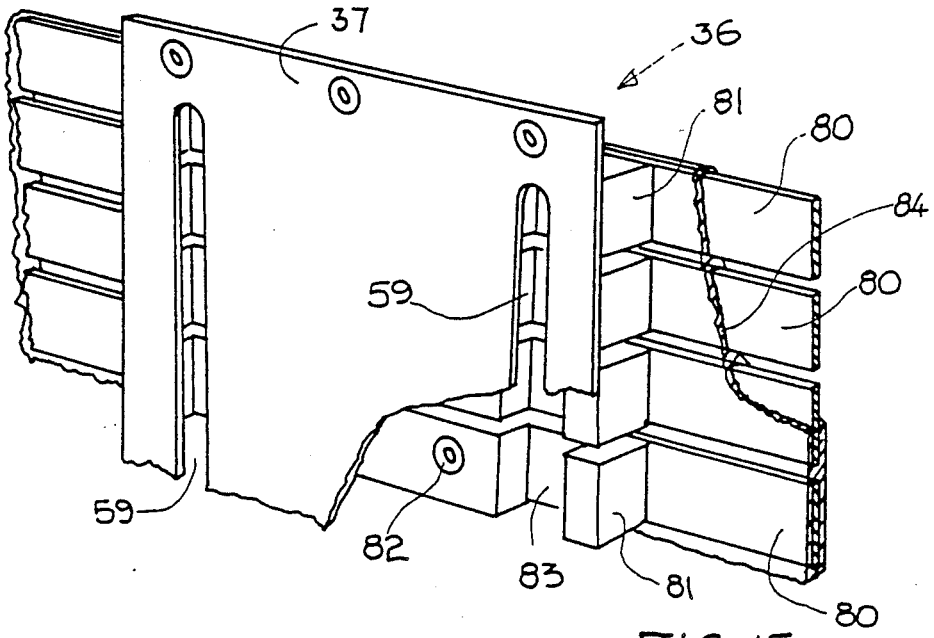
FIG. 15 is a perspective view of a detail of the apparatus of FIG. 1.
Figure 22:
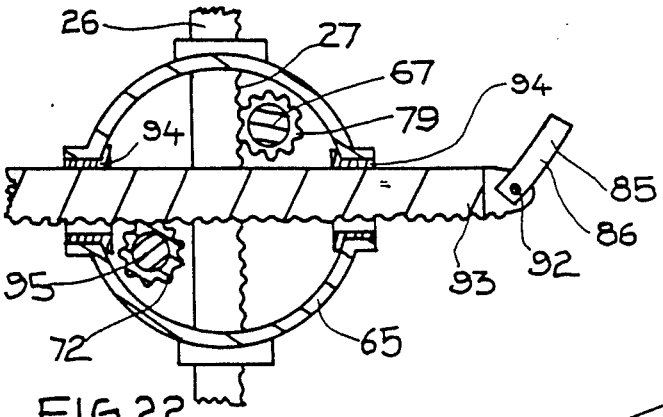
FIG. 22 is a sectional view of the detail of FIG. 21.
Figure 21:
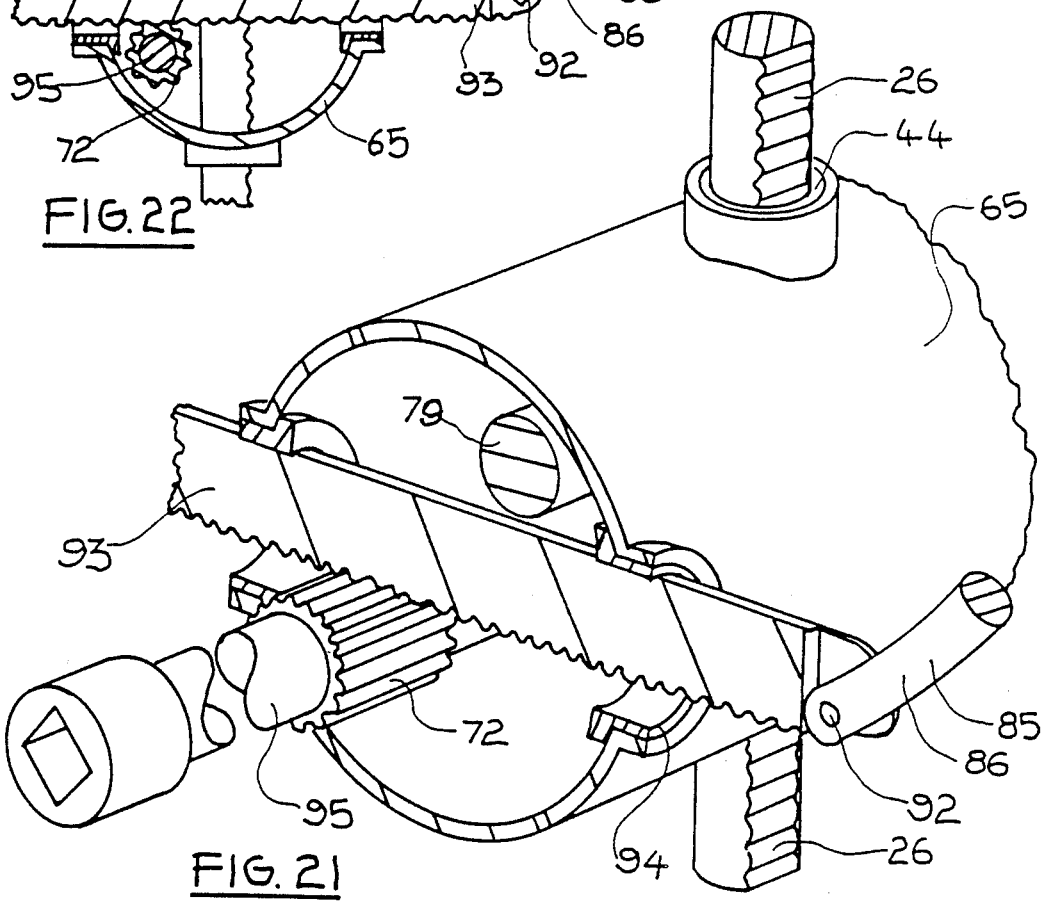
FIG. 21 is a view similar to FIG. 19 of another detail of the apparatus of FIG. 1.
Figure 20:
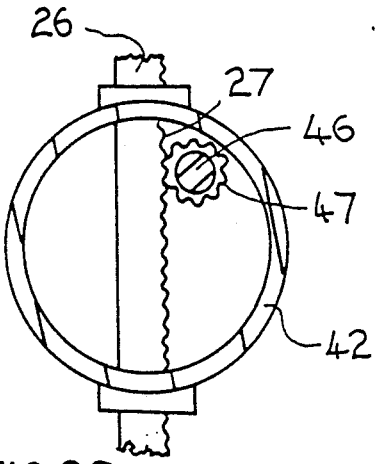
FIG. 20 is a sectional view of the detail of FIG. 19.
Figure 19:
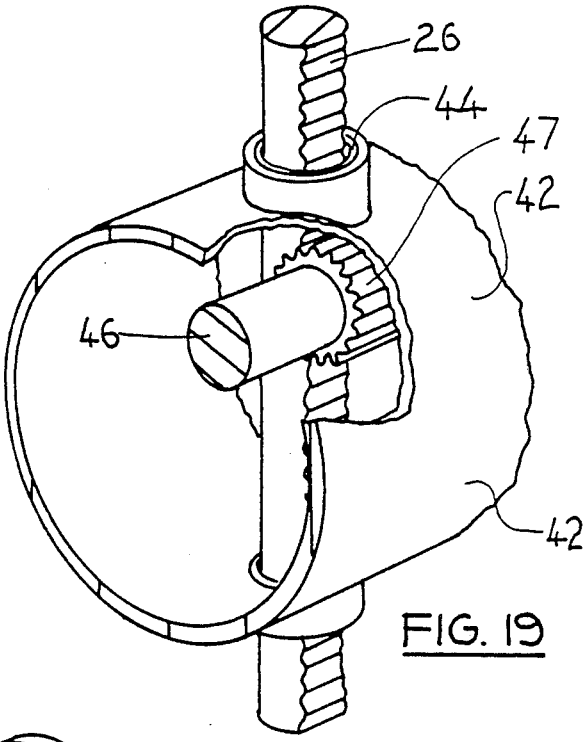
FIG. 19 is a perspective view of another detail of the apparatus of FIG. 1.
Figure 24:
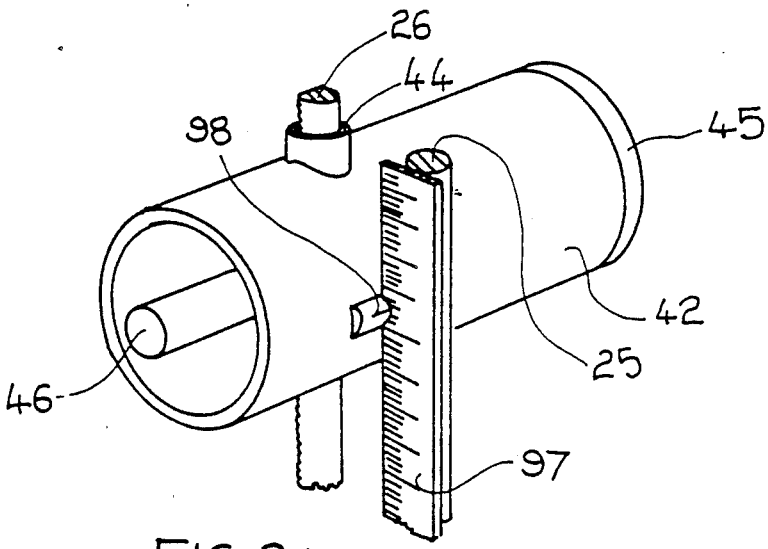
FIG. 24 is a perspective view of a further detail of the apparatus of FIG. 1.
Figure 23:
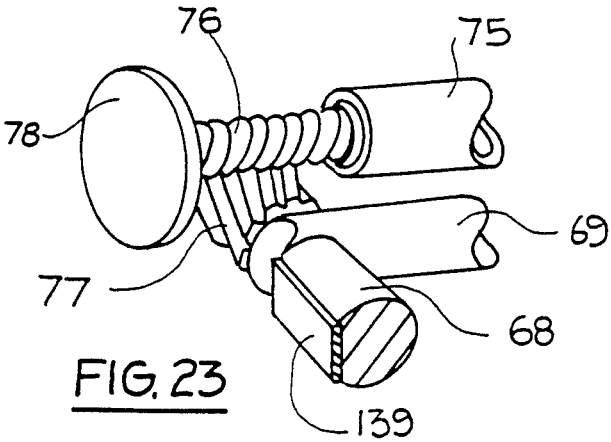
FIG. 23 is a perspective view of another detail of the apparatus of FIG. 1.

The lower support member 65 is moved downwardly to a position below the upholstered seat 6. The clamping means 43 and 74 are tightened to secure the back engaging member 36 to the transverse members 55 and 68. The lower support member 65 is then raised by rotating the shaft 63, thereby causing the back engaging member 36 to deform outwardly and form an arcuate shape to engage the small of the individual's back, as illustrated in FIGS. 4 and 8. Further slight movement of the intermediate support member 52 causes the back engaging member 36 to deform inwardly, thereby acommodating the curvature of the upper portion of the individuals back. Thus, the back support member 36 takes up the vertical curvature of the individual's back.

The curvature of the portion of the back engaging member 36 between the intermediate transverse member 55 and the lower transverse member 68 is increased by bringing the two transverse members 65 and 68 together. The curvature is decreased by moving the members 65 and 68 apart. Further, the position of the curved portion of the back engaging member 36 between the transverse members 55 and 68 may be raised or lowered by raising or lowering the transverse members 55 and 68. However, where it is desired to raise or lower the position of the curve between the transverse members 55 and 68 this should be done with the clamping members 43 and 74 released from the sheet member 37.

Further, the angle of the back engaging member 36 adjacent the transverse member 68 may be varied by rotating the worm wheel 77 by the worm 76. This, as well as changing the angle of the back engaging member 36 at the transverse member 68, also varies the position of the peak of the curve intermediate the transverse members 55 and 68. For convenience, the peak of the curve is indicated by the reference numeral 140, see FIGS. 4 and 8. When carrying out this adjustment, it may be necessary to release the clamping members 74 to enable more of the back engaging member 36 to be fed across the transverse member 68 to accommodate the increased curvature.

The side members 85 are moved outwardly by rotating the shaft 95 in the lower support member 65. As the side members 85 move outwardly, they engage the transverse strips 80, and further movement of the side members 85 causes the transverse strips 80 to be deformed outwardly around the individual's back, see FIG. 5. Thus, the transverse strips 80 take up the horizontal curvature of the back of the individual. The side members 85 are moved outwardly until the transverse strips 80 are in good engagement with the individual's back. The fact that the lower portion of each side member 85 is of arcuate shape and that the upper portion inclines downwardly inwardly from the bracket 90 facilitates in shaping the transverse members 80 to take up the horizontal contours of the back of an individual over the length of the back.

Accordingly, both the horizontal and vertical contour of the individual's back is taken up by the back engaging member 36 and the neck engaging member 101 indicates the neck position. The vertical position of the top intermediate and bottom support members 42, 52 and 65 are recorded from the rule 97. The vertical position of the support member 105 is also recorded from the rule 97. The horizontal position of the neck engaging member 101 relative to the support member 105 is recorded from the rule 111 and the position of the lower portion of the side members 85 is recorded from the rule 99. The angular inclination of the back portion 4 relative to the seat portion 3 is recorded from the protractor 34. The angular position of the upholstered seat 6 relative to the framework and the position of the arm rests are also recorded.

The side members 85 are moved inwardly to disengage the transverse strips 80. With the clamping means 43 and 74 still clamping the back engaging member 36, the intermediate support member 52 and lower support member 65 are moved downwardly until the back engaging member 36 is straight, see FIG. 9. These second vertical positions of the support members 52 and 65 are similarly recorded.

Thus, having the above recorded positions, it is possible to reconstruct the vertical and horizontal contours of the back engaging member 36 and the position of the neck engaging member 101 as desired. The advantage of this is that where a number of identical measuring chairs are provided in different locations, the user of each chair can transmit appropriate dimensions from the measuring chair to a central receiving location which can reconstruct the curvature of the back engaging member and neck engaging member position to enable a chair with a back portion of the appropriate shape to be manufactured to an individual's needs.

While the measuring chair according to the present invention has many advantages, one of the most important advantages arises from the fact that by recording a relatively few dimensions, the entire contour, both vertical and horizontal, of an individual's back can be recorded. Thus, it is possible to have a large number of chairs provided at remote locations which, on measuring an individual, would forward the measurements to a central location where the contours would be reconstructed on an identical chair using the dimensions. In this way, an orthopaedic chair with the appropriately shaped back, angled seat and neck rest and arm rest at the appropriate height can be constructed.

In constructing the back of the orthopaedic chair, many techniques may be used, and these will be known to those skilled in the art. For example, it is envisaged in certain cases a fibreglass shell of the back of an orthopaedic chair would be formed on the back engaging member 36. Fibreglass material would be laid up on the back engaging member 36 over the silicon rubber membrane 84. The fibreglass shell, on setting, would be removed from the back engaging member 36 and would lined with polyurethene foam or other suitable cushioning material of relatively uniform thickness. A headrest similar to the upholstered portion 103 of the headrest would be mounted in the fibreglass shell at a position corresponding to the position recorded from the measuring chair. Alternatively, a plug may be taken from the back engaging member and headrest which would be used as the male portion of a mould for forming the back portion of the orthopaedic chair. A relatively rigid foam type material could then be cast in the mould to form a cushion which would be supported on an upstanding back of the orthopaedic chair. The advantage of forming a silicon rubber membrane 84 over the transverse strips 80 is that the back engaging member 36 may be used for laying up fibreglass or any other suitable material, and by virtue of the fact that the membrane 84 is of silicon rubber material, the material laid onto the membrane 84 may be easily released therefrom.

Figure 25:
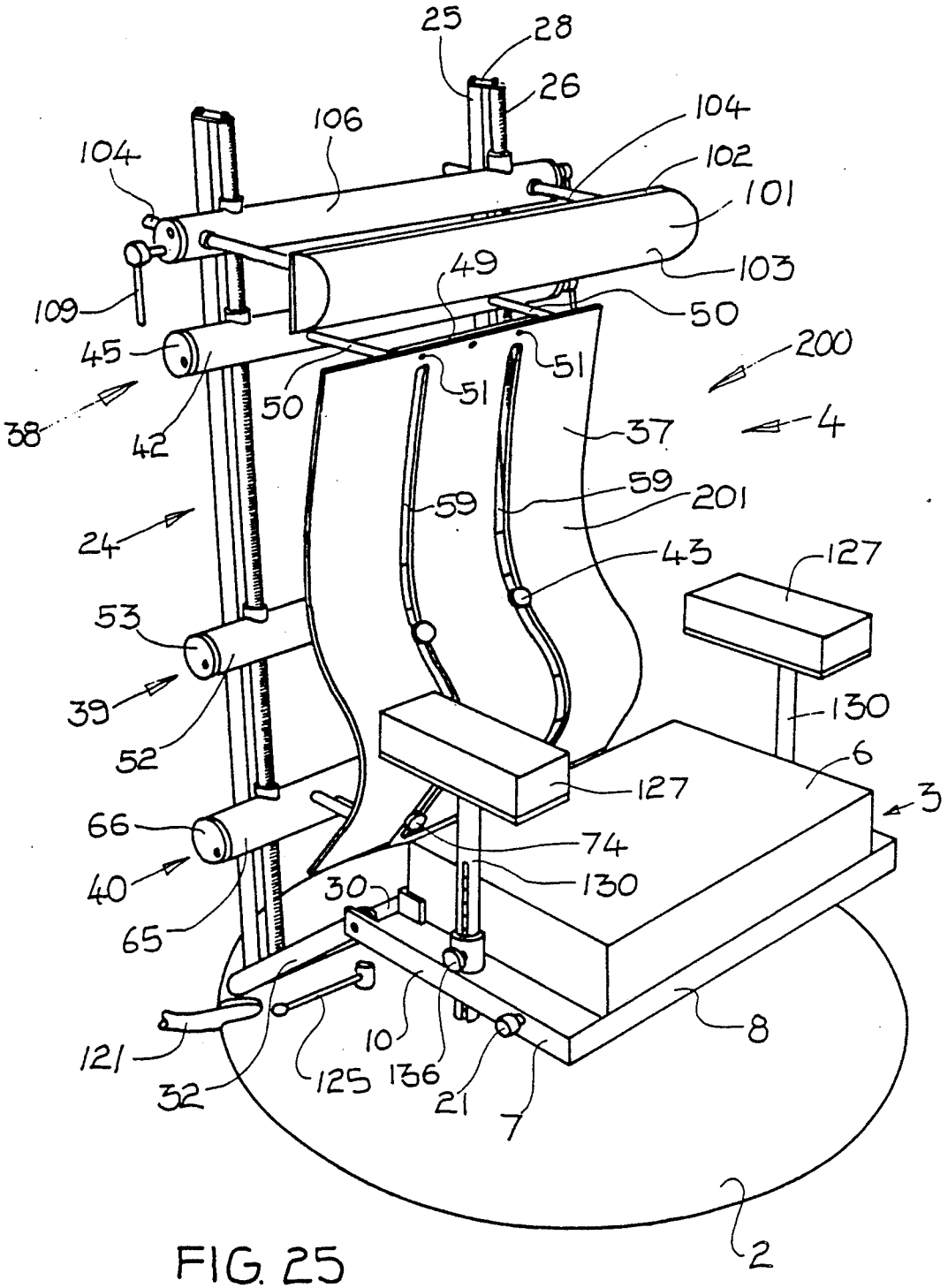
FIG. 25 is a perspective view of a chair also according to the invention.

Referring now to FIG. 25, there is illustrated a chair also according to the invention indicated by the reference numeral 200. The chair 200 is somewhat similar to the measuring chair of FIGS. 1 to 24, and similar components are identified by the same reference numerals, however, in this case, the chair 200 is for normal use by an individual. The chair 200 comprises a back engaging member 201 which comprises a sheet member 37 similar to the carbon fibre sheet member 37. However, in this case, the spring steel transverse strips and the mounting members have been removed. The sheet member 37 extends substantially the width of the back portion 4 of the chair and is upholstered. For ease of illustration in FIG. 25, the upholstered portion is not shown. In practice, the chair 200 will look substantially similar to a normally upholstered chair back. The advantage of providing a chair with a back portion including the back engaging member 201 is that the back engaging member 201 may be adjusted to take up the vertical curvature of the contour of the individual's back. The neck engaging member 101 can also be adjusted inwardly and outwardly and vertically.

A suitable housing (not shown) either upholstered or otherwise, is provided around the upstanding members 25 and the gear racks 26 to provide an aesthetically pleasing chair. Similarly, it is envisaged that the side connecting members 32 and the seat framework 7 may be upholstered.

In use, when an individual wishes to use the chair, the angle of the seat and its height can be adjusted as already described with reference to the chair 1. The angle of the back portion and the height of the arm rests similarly can be adjusted. The individual then sits into the chair and by moving the mounting means 38, 39 and 40 upwardly or downwardly as the case may be, as already described, the curvature of the back engaging member can be adjusted to take up the curvature of the individual's back.

In certain cases, it is envisaged that a chair similar to the chair 200 may be provided with a back engaging member which would be mounted by only two mounting means. In which case, the back engaging member may extend substantially the height of the back portion, or in other cases, it is envisaged that the back engaging member will be provided between the position of the intermediate mounting means and the lower mounting means. In which case, the back engaging member would be adjustable to take up the curvature of the vertical contour of the lower portion of an individual's back. The upper back portion of the chair would not be adjustable.

It is also envisaged that in certain cases the chair 200 may be provided with a plurality of transverse spring steel strips similar to the strips 80, mounted on the back engaging member 37. In which case, it will be appreciated that the transverse strips will be covered by upholstery. Where transverse strips are provided, it is envisaged that the side members 85 for causing the back engaging member to take up the horizontal curvature of the contours of the individual's back will also be provided.

In certain cases, it is envisaged that the chair or measuring chair may be provided without the neck engaging member, and where a neck engaging member is provided, it may be adjustable in one direction only.

It will be appreciated that while the apparatus according to the invention has been described as comprising a measuring chair with a back portion, the inclination of which may be varied relative to the seat portion, while this is preferable, it is not essential. Similarly, in the case of the chair of FIG. 25, it is not necessary for the inclination of the back portion to be variable. Further, it will be appreciated that the construction of the seat portion, base and arm rests may be varied without departing from the scope of the invention. Indeed, in certain cases, it is envisaged that the arm rest may be dispensed with altogether. It will be appreciated that while it is advantageous to provide the seat portion as comprising a framework and an upholstered seat, this is not necessary. Any other suitable construction of seat portion could be used. Indeed, in certain cases, it will be appreciated that the adjustment means for varying the angle of the upholstered seat portion may be dispensed with.

It will also be appreciated that while the back engaging member of the measuring chair and chair has been described as being of carbon fibre material, any other suitable material could be used. Needless to say, the flexible sheet member of the back engaging member may be of any other width, shape or construction. Indeed, any other means for slidably mounting it relative to the mounting means could be used without departing from the scope of the invention. Similarly, any other suitable transverse strips may be used besides those described, and more or less may be used at greater or lesser spacings. Indeed, in certain cases, it is envisaged that the transverse strips may be dispensed with without departing from the scope of the invention. Further, where the transverse strips are dispensed with, the silicon rubber membrane may also be dispensed with. In other cases, the transverse strips may be provided without the silicon rubber membrane. Needless to say, a membrane of any other material besides silicon rubber could be provided. Where the transverse strips are provided, any other suitable means for mounting them to the flexible elongated sheet member may be used. In fact, the back engaging member may, in certain cases, be provided by a sheet member only and the sheet member may be of relatively narrow width, in other words, provided by a relatively narrow strip of material.

It is also envisaged in certain cases that the silicon rubber membrane over the transverse strips may extend upwardly to extend over the neck engaging member.

It will also be appreciated that other suitable clamping means besides those described may be used for clamping the back engaging member to the mounting means.

It is envisaged that mounting means other than those described for mounting the back engaging member to the upstanding members may be used without departing from the scope of the invention. Needless to say, other suitable means for raising and lowering the mounting means may be used. In certain cases, it is envisaged that only two mounting means may be provided, although needless to say, three are preferable. It is also envisaged in certain cases that one of the mounting means may be rigidly mounted to the upstanding members. Needless to say, a back portion of other shape and construction besides that described could be used without departing from the scope of the invention.

It will also be appreciated that the worm and worm wheel for pivoting the lower intermediate member may be dispensed with.

In certain cases, it is envisaged that a set square may be provided for taking check measurements of the curve profile. Such measurements would normally be taken using the upstanding members 25 as a datum point.

While the apparatus has been described as being a chair for measuring the contour of an individuals back, it is envisaged that a chair could be provided with a back engaging member similar to that described in the measuring chair, and accordingly, one could have a chair with a back engaging member which could be readily easily adjusted to take up the contour of an individuals back. In other words, one would essentially be providing a chair with an adjustable back. Further, where such a chair is provided, it is envisaged that the chair would comprise a back engaging member with two or three mounting means similar to those already described, and in certain cases, the side members would also be provided for varying the horizontal curvature of the back.

Needless to say, while certain materials have been described for use in various components of the apparatus, any other suitable materials could be used without departing from the scope of the invention, as indeed could other constructions be used.

I claim:

1. Apparatus for measuring the contour of the back of an individual in a seated position, the apparatus comprising a chair which comprises:

a seat portion, an upstanding back portion comprising at least one upstanding member extending upward from the seat portion, a back engaging member formed from an elongated flexible member extending in a generally upward direction and being deformable to take up the vertical contour of at least part of the individual's back, a first mounting means for mounting the back engaging member to the upstanding back portion, the first mounting means comprising a first support member mounted on the upstanding member of the back portion, a second mounting means for mounting the back engaging member to the upstanding back portion at a position spaced apart from the first mounting means, the second mounting means comprising:

a second support member mounted on the upstanding member of the back portion, a first mounting member slidably engagable with the back engaging member to permit relative movement between the second mounting means and the back engaging member longitudinally relative to the back engaging member, the first mounting member being mounted on the second support member and being pivotal relative to the second support member about a pivot axis transverse of the back engaging member, and first clamping means being provided on the first mounting member for releasably clamping the back engaging member to the first mounting member, and at least one of said support members being slidably mounted on the upstanding member of the back portion so that the said at least one of said mounting means is slidable on the upstanding member of the back portion relative to the other mounting means in a direction longitudinally of the back engaging member for deforming the back engaging member to take up the contour of the back of the individual; and datum means for permitting the relative positions of the mounting means on the upstanding back portion to be recorded for determining the contour of the back of the individual.

2. Apparatus as claimed in claim 1 in which each support member is slidably mounted on the upstanding member of the back portion.

3. Apparatus as claimed in claim 1 in which the first mounting means is provided on the upstanding back portion above the second mounting means.

4. Apparatus as claimed in claim 1 in which the upstanding back portion comprises a pair of spaced apart upstanding members, and each support member extends between the upstanding members and is slidably mounted thereon, and said first mounting member is provided by an elongated transverse member extending parallel with the second support member.

5. Apparatus as claimed in claim 1 in which the first mounting means comprises a second mounting member for carrying the back engaging member, the second mounting member being mounted on the first support member and being pivotal relative to the first support member about a pivot axis transverse of the back engaging member.

6. Apparatus as claimed in claim 4 in which intermediate mounting means are provided intermediate the first and second mounting means, the intermediate mounting means comprising a third support member slidable on the upstanding member of the back portion, and a third mounting member slidably engagable with the back engaging member to permit relative movement between the intermediate mounting means and the back engaging member longitudinally relative to the back engaging member, the third mounting member being mounted on the third support member and being pivotal relative to the third support member about a pivot axis transverse of the back engaging member, and second clamping means being provided on the third mounting member for releasably clamping the back engaging member to the third mounting member.

7. Apparatus as claimed in claim 6 in which an elongated slot is provided on the back engaging member to slidably engage the first and third mounting members.

8. Apparatus as claimed in claim 1 in which the back engaging member extends part of the width of the back portion and is centrally located relative to the back portion and a plurality of transverse strips of resilient materials are secured to the back engaging member and extend sidewardly thereof from each side of the back engaging member to take up horizontal contours of the individual's back.

9. Apparatus as claimed in claim 8 in which a pair of elongated side members extending in a generally upward direction are provided on the back portion to engage free ends of the transverse strips, the side members being movable relative to the back portion to engage and deform the transverse strips to take up horizontal contours of the individual's back.

10. Apparatus as claimed in claim 1 in which a neck engaging member is provided on the back portion to engage the neck of the individual, the neck engaging member being movable inwardly and outwardly and vertically relative to the back portion.

11. Apparatus as claimed in claim 1 in which said datum means comprises measuring means for measuring the distance in a generally upward direction between the respective mounting means and a datum point.

12. A method for measuring the contour of the back of an individual comprising the steps of:

seating the individual in a chair having a seat portion, an upstanding back portion, a back engaging member, and three mounting means for mounting the back engaging member to the upstanding back portion, namely an upper mounting means, a lower mounting means and an intermediate mounting means intermediate the upper and lower mounting means, adjusting the height of the respective mounting means with the back engaging member substantially straight so that the upper mounting means is adjacent to the shoulder of the individual, the intermediate mounting means is adjacent a position halfway down the individual's back, and the lower mounting means is below the level of the seat, securing the back engaging member to the upper, intermediate and lower mounting means, raising the lower mounting means towards the intermediate mounting means to cause a portion of the back engaging member intermediate the intermediate and lower mounting means to curve outwardly to engage the individual's back, lowering the upper mounting means towards the intermediate mounting means to cause a portion of the back engaging member intermediate the upper and intermediate mounting means to curve inwardly to engage the individual's back, recording the position of the respective mounting means relative to datum point, and lowering the intermediate and lower mounting means until the back engaging member is substantially straight and recording the new positions of the intermediate and lower mounting means relative to the datum point.

13. Apparatus for measuring the contour of the back of an individual in a seated position, the apparatus comprising a chair which comprises:

a seat portion, a upstanding back portion extending upward from the seat portion, a back engaging member formed from an elongated flexible member extending in a generally upward direction and being deformable to take up the vertical contour of at least part of the individual's back, the back engaging member extending part of the width of the back portion and being centrally located relative to the back portion, at least two mounting means for mounting the back engaging member to the upstanding back portion at respective vertically spaced apart portions, a plurality of transverse strips of resilient material secured to the back engaging member and extending sidewardly thereof from each side of the back engaging member to take up horizontal contours of the individual's back, and a pair of elongated side members extending in a generally upward direction provided on the back portion to engage free ends of the transverse strips, the side members being movable relative to the back portion to engage and deform the transverse strips to take up the horizontal contours of the individual's back to allow for the measuring of the horizontal contours of the individual's back.

14. A chair comprising a seat portion, an upstanding back portion comprising at least one upstanding member extending upward from the seat portion, a back engaging member formed from an elongated flexible member extending in a generally upward direction and being deformable to take up the vertical contour of at least part of the individual's back, a first mounting means for mounting the back engaging member to the upstanding back portion, the first mounting means comprising a first support member mounted on the upstanding member of the back portion, a second mounting means for mounting the back engaging member to the upstanding back portion at a position spaced apart from the first mounting means, the second mounting means comprising:

a second support member mounted on the upstanding member of the back portion, a first mounting member slidably engagable with the back engaging member to permit relative movement between the second mounting means and the back engaging member longitudinally relative to the back engaging member, the first mounting member being mounted on the second support member and being pivotal relative to the second support member about a pivot axis transverse of the back engaging member, and first clamping means being provided on the first mounting member for releasably clamping the back engaging member to the first mounting member, and at least one of said support members being slidably mounted on the upstanding member of the back portion so that the said at least one of said mounting means is slidable on the upstanding member of the back portion relative to the other mounting means in a direction longitudinally of the back engaging member for deforming the back engaging member to take up the contour of the back of the individual.

* * * * *